US007597047B2

(12) United States Patent
Doyle et al.

(10) Patent No.: US 7,597,047 B2
(45) Date of Patent: Oct. 6, 2009

(54) SIMULATING AN EXPLOSION OF AN IMPROVISED EXPLOSIVE DEVICE

(75) Inventors: Thomas Doyle, Helendale, CA (US); Diana P. Schaeffer, Denville, NJ (US)

(73) Assignees: Raytheon Company, Waltham, MA (US); Pacific Coast Systems LLC, Asbury, NJ (US)

( * ) Notice: Subject to any disclaimer, the term of this patent is extended or adjusted under 35 U.S.C. 154(b) by 201 days.

(21) Appl. No.: 11/427,855

(22) Filed: Jun. 30, 2006

(65) Prior Publication Data

US 2008/0000377 A1 Jan. 3, 2008

(51) Int. Cl.
*F41A 33/04* (2006.01)
*F42B 4/00* (2006.01)

(52) U.S. Cl. ..... 102/355; 102/358; 102/360; 434/16

(58) Field of Classification Search ..... 102/335, 102/355, 358, 360, 202.14; 434/11, 16; 86/50; 89/1.1
See application file for complete search history.

(56) References Cited

U.S. PATENT DOCUMENTS

| | | | | |
|---|---|---|---|---|
| 1,370,193 A | | 3/1921 | Crocker | 200/83 R |
| 2,396,699 A | | 3/1946 | Hayes et al. | 200/61.01 |
| 2,421,491 A | | 6/1947 | Gearon et al. | 89/1.1 |
| 2,526,670 A | | 10/1950 | Kissinger et al. | 102/402 |
| 2,717,533 A | | 9/1955 | Wells | 89/1.51 |
| 2,962,965 A | | 12/1960 | Farnsworth et al. | 102/420 |
| 3,054,870 A | | 9/1962 | Wagoner | 200/61.45 R |
| 3,336,870 A | | 8/1967 | Gunyan et al. | 102/342 |
| 3,535,809 A | | 10/1970 | Hoffmann | 42/106 |
| 3,721,190 A | | 3/1973 | Lewis et al. | 102/402 |
| 3,722,418 A | * | 3/1973 | Hoffmann | 102/355 |
| 3,752,082 A | | 8/1973 | Kernan | 102/37.8 |
| 3,808,940 A | | 5/1974 | Schillreff et al. | 89/1 R |
| 4,014,262 A | * | 3/1977 | Betts | 102/335 |
| 4,217,717 A | | 8/1980 | Canty et al. | 42/1 R |
| 4,245,403 A | | 1/1981 | Hipp | 434/11 |
| 4,307,665 A | | 12/1981 | Block et al. | 102/505 |

(Continued)

FOREIGN PATENT DOCUMENTS

DE 3506412 A1 8/1986

(Continued)

OTHER PUBLICATIONS

Erwin, Sandra I., "*Mock 'IEDs' Help Soldiers Prepare for War*", National Defense Magazine, http://www.nationaldefensemagazine.org/issues/2005/Dec1/UF-Mock.htm, 3 pages, Dec. 2005.

(Continued)

*Primary Examiner*—James S Bergin
(74) *Attorney, Agent, or Firm*—Baker Botts L.L.P.

(57) ABSTRACT

According to one embodiment, a system for simulating an actual explosion of an explosive device includes one or more firing devices and a control module. A firing device comprises a pyrotechnic device operable to direct a pyrotechnic explosion in a predetermined direction to simulate the actual explosion of the explosive device. The control module receives a trigger signal from a trigger device, which is operable to send the trigger signal in response to a trigger event. The control module detonates the firing devices in response to the trigger signal.

20 Claims, 2 Drawing Sheets

U.S. PATENT DOCUMENTS

| | | | | |
|---|---|---|---|---|
| 4,325,304 | A | 4/1982 | Ormiston | 102/200 |
| 4,342,556 | A | 8/1982 | Hasse | 434/22 |
| 5,117,731 | A | 6/1992 | Mendenhall | 89/1.816 |
| 5,157,222 | A | 10/1992 | La Mura et al. | 102/355 |
| 5,235,127 | A * | 8/1993 | Findley | 102/200 |
| 5,282,455 | A | 2/1994 | Adamson et al. | 124/59 |
| 5,381,721 | A | 1/1995 | Holmström et al. | 89/1.51 |
| 5,450,686 | A * | 9/1995 | La Mura et al. | 42/84 |
| 5,554,817 | A * | 9/1996 | La Mura et al. | 102/217 |
| 5,559,303 | A | 9/1996 | La Mura et al. | 89/28.05 |
| 5,563,366 | A * | 10/1996 | La Mura et al. | 102/217 |
| 5,688,124 | A | 11/1997 | Salzeder | 434/11 |
| 5,739,459 | A | 4/1998 | La Mura et al. | 102/217 |
| 5,739,462 | A | 4/1998 | Poor et al. | 102/342 |
| 5,767,437 | A * | 6/1998 | Rogers | 102/200 |
| 6,205,927 | B1 * | 3/2001 | Findley | 102/472 |
| 6,237,273 | B1 * | 5/2001 | La Mura et al. | 42/84 |
| 6,318,350 | B1 | 11/2001 | Williams | 124/71 |
| 6,393,990 | B1 * | 5/2002 | Fagan | 102/342 |
| 6,431,070 | B1 | 8/2002 | La Mura | 102/202.11 |
| 6,502,343 | B2 | 1/2003 | Cheng | 42/1.15 |
| 6,505,558 | B1 | 1/2003 | La Mura et al. | 102/217 |
| 6,599,127 | B1 | 7/2003 | Hopmeier et al. | 434/16 |
| 7,314,005 | B2 * | 1/2008 | Deye | 102/356 |
| 7,507,089 | B2 * | 3/2009 | Jones et al. | 434/11 |
| 2006/0123684 | A1 | 6/2006 | Bunney | 42/60 |
| 2006/0162602 | A1 * | 7/2006 | Garms et al. | 102/335 |
| 2007/0015115 | A1 * | 1/2007 | Jones et al. | 434/11 |
| 2007/0166667 | A1 * | 7/2007 | Jones et al. | 434/11 |

FOREIGN PATENT DOCUMENTS

| | | |
|---|---|---|
| DE | 196 17 060 C2 | 6/1997 |
| DE | 196 17 061 C2 | 6/1997 |

OTHER PUBLICATIONS

"*Training Improvised Explosive Device (TIED)*", Solution : Unitech, www.UNITECH1.com, 1 page, Printed May 17, 2006.

"Simulation, Solution: Unitech", Simulation: Simulator Upgrades and Modifications, Design and Develop 3D Visual Databases and Modifications for Real-Time, http://www.unitech1.com/solutions_sim_p2.htm, 5 pages, Printed May 17, 2006.

Pending U.S. Appl. No. 10/713,127 entitled "*Multi-Purpose Pyrotechnic Trainer*" (MPT-30), by Ronald M. Stria, 28 pages of specification, claims and abstract, 12 drawing sheets, Nov. 14, 2003.

United States Patent Office; Office Action for U.S. Appl. No. 10/713,127, filed Nov. 14, 2003 entitled "*Multi-Purpose Pyrotechnic Trainer*", by Ronald M. Stria, 8 pages, Apr. 16, 2008.

Response to Office Action dated Apr. 16, 2008 for U.S. Appl. No. 10/713,127, filed Nov. 14, 2003 entitled "*Multi-Purpose Pyrotechnic Trainer*", by Ronald M. Stria, 13 pages, Sep. 16, 2008.

United States Patent Office, Notice of Allowance and Fee(s) Due for U.S. Appl. No. 10/713,127, filed Nov. 14, 2003 entitled "*Multi-Purpose Pyrotechnic Trainer*", by Ronald M. Stria, 6 pages, Apr. 6, 2009.

* cited by examiner

SIMULATING AN EXPLOSION OF AN IMPROVISED EXPLOSIVE DEVICE

GOVERNMENT FUNDING

This invention was made with Government support under N61339-00-D-0001 awarded by the Naval Air Warfare Center, Training Systems Division for the Program Executive Office for Simulation, Training, and Instrumentation (PEO STRI). The Government has certain rights in this invention.

TECHNICAL FIELD

This invention relates generally to the field of explosion simulation and more specifically to simulating an explosion of an improvised explosive device.

BACKGROUND

Enemy combatants often use explosive devices such as improvised explosive devices to cause damage, injury, and death. Accordingly, military personnel are trained to deal with explosive devices. During training, military personnel may use simulators that simulate the explosions caused by explosive devices.

Explosive device simulators that provide realistic simulations better train military personnel to deal with explosive devices. Moreover, the simulations should be safe in order to avoid harming military personnel. Accordingly, it is desirable to have explosive device simulators that provide realistic, yet safe, simulations of explosions.

SUMMARY OF THE DISCLOSURE

In accordance with the present invention, disadvantages and problems associated with previous techniques for simulating explosive devices may be reduced or eliminated.

According to one embodiment of the present invention, a system for simulating an actual explosion of an explosive device includes one or more firing devices and a control module. A firing device comprises a pyrotechnic device operable to direct a pyrotechnic explosion in a predetermined direction to simulate the actual explosion of the explosive device. The control module receives a trigger signal from a trigger device, which is operable to send the trigger signal in response to a trigger event. The control module detonates the firing devices in response to the trigger signal.

Certain embodiments of the invention may provide one or more technical advantages. A technical advantage of one embodiment may be that an explosion simulator may utilize pyrotechnic firing devices that fire pyrotechnic cartridges. The pyrotechnic firing devices may yield a more realistic simulation of an explosion.

Another technical advantage of one embodiment may be that firing devices of an explosion simulator may be designed to direct an explosion in a predetermined direction. For example, the explosion may be directed in a vertical direction perpendicular to the surface of the earth, while projectiles in a horizontal direction parallel to the surface of the earth are minimized. Directing the explosion in this manner may reduce risk of injury to participants.

Yet another technical advantage of one embodiment may be that an explosion simulator may include one or more ports operable to couple external devices to the simulator. The external devices may include any of a variety of external trigger devices. The ports may allow for different types of trigger devices to be used in a simulation.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Figure 1:
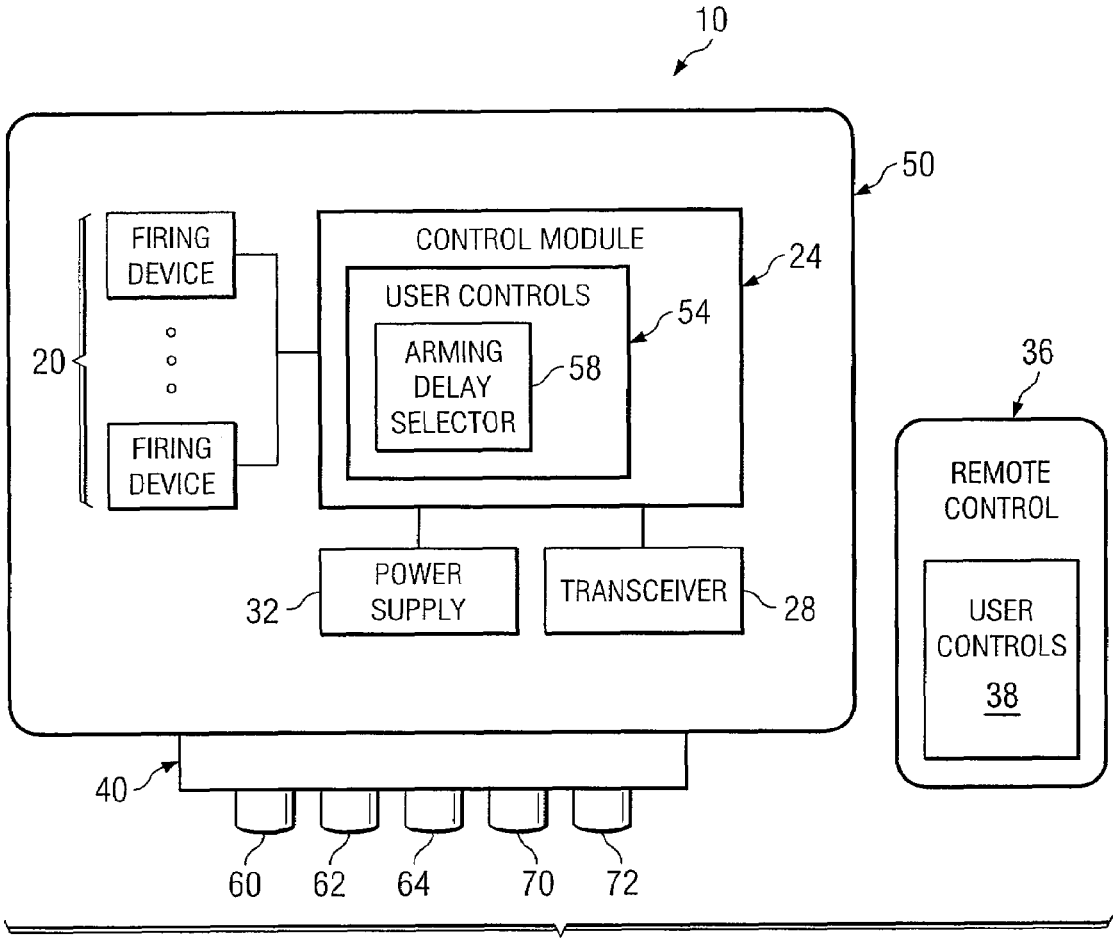
FIG. 1 is a block diagram illustrating one embodiment of a system for simulating an explosive device.
Figure 2:
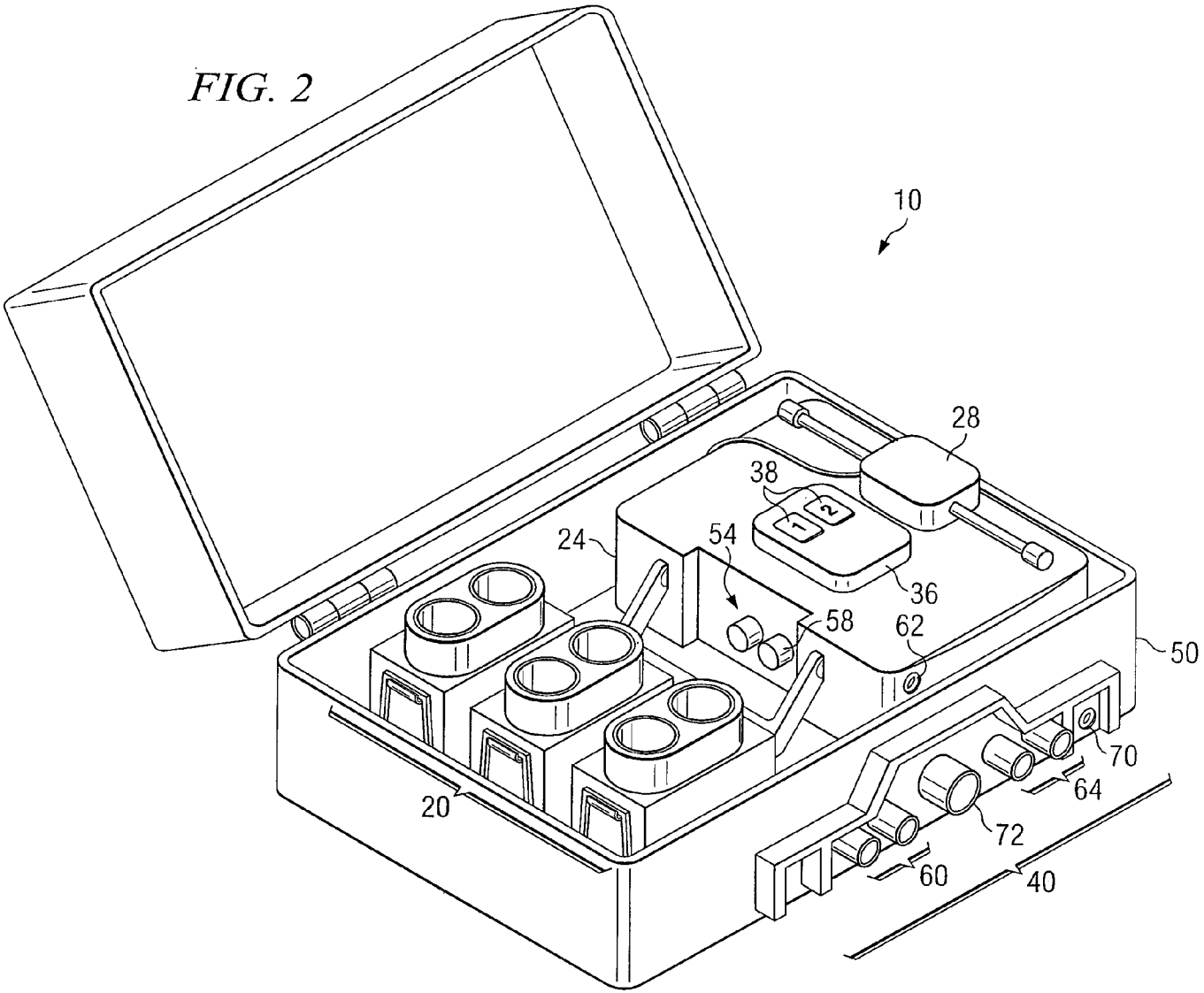
FIG. 2 is a diagram illustrating an example of the embodiment of the system of FIG. 1.

Embodiments of the present invention and its advantages are best understood by referring to FIGS. 1 and 2 of the drawings, like numerals being used for like and corresponding parts of the various drawings.

FIG. 1 is a block diagram illustrating one embodiment of a system 10 for simulating an explosive device. According to the embodiment, system 10 simulates the distinctive signature of an explosive device. For example, system 10 may simulate the visual and audio signatures of an improvised explosive device (IED). System 10 may be referred to as a self contained portable IED simulator (SCoPIS), or a "six-pack."

According to one embodiment, system 10 may utilize pyrotechnic firing devices that fire pyrotechnic cartridges. The pyrotechnic firing devices may yield a more realistic simulation of an explosion. According to another embodiment, firing devices of system 10 may be designed to direct an explosion in a predetermined direction. For example, the explosion may be directed in a vertical direction perpendicular to the surface of the earth, while projectiles in a horizontal direction parallel to the surface of the earth are minimized. Directing the explosion in this manner may reduce risk of injury to participants. According to yet another embodiment, system 10 may include one or more ports operable to couple external devices to the simulator. The external devices may include any of a variety of external trigger devices. The ports may allow for different types of trigger devices to be used in a simulation.

An improvised explosive device may refer to any suitable explosive device that typically includes an initiation system, explosive material, a detonator, a power supply, or any suitable combination of the preceding. The explosive material may include commercial, military, or homemade explosives, and may be used alone or in combination with other substances such as toxic chemicals, biological toxins, or radioactive material.

An IED may be of any suitable size, and may be delivered by any suitable delivery method. For example, a smaller-sized device may be carried by a person, a medium-sized device may be tossed or thrown by one or more people, and a larger-sized device may be transported by a vehicle.

An IED may typically be regarded as a "homemade" device. An IED, however, need not necessarily be homemade. An IED may be a factory or mass-produced device that is used by an enemy combatant to create an explosion.

In general, system 10 may include any suitable arrangement of components operable to perform the operations of system 10, and may comprise logic, an interface, memory, other component, or any suitable combination of the preceding. "Logic" may refer to hardware, software, other logic, or any suitable combination of the preceding that may be used to provide information or instructions. Certain logic may manage the operation of a device, and may comprise, for example, a processor. "Processor" may refer to any suitable device operable to execute instructions and manipulate data to perform operations.

"Interface" may refer to logic of a device operable to receive input for the device, send output from the device, perform suitable processing of the input or output or both, or any combination of the preceding, and may comprise one or more ports, conversion software, or both. "Memory" may refer to logic operable to store and facilitate retrieval of information, and may comprise Random Access Memory (RAM), Read Only Memory (ROM), a magnetic drive, a disk drive, a Compact Disk (CD) drive, a Digital Video Disk (DVD) drive, removable media storage, any other suitable data storage medium, or a combination of any of the preceding.

According to the illustrated embodiment, system 10 includes one or more firing devices 20, a control module 24, a transceiver 28, a power supply 32, a remote control 36, and one or more interfaces 40. One or more components of system 10 may be integrated or separated according to particular needs. If any components are separated, the separated components may communicate using a bus, a cable such as a dual in-line banana cable, an air interface, a network, or any other appropriate wired, wireless, or other link.

A firing device 20 represents a device operable to simulate one or more distinctive signatures, for example, the visual, audio, or both visual and audio signatures, of an explosive device. According to one embodiment, a firing device 20 comprises a pyrotechnic device that fires pyrotechnic cartridges to simulate the signatures. Any suitable pyrotechnic cartridge may be used, for example, M30 or M31A1 cartridges.

According to one embodiment, a firing device 20 may receive a detonation signal from control module 24 and transmit the signal to a pyrotechnic cartridge. A pyrotechnic cartridge includes pyrotechnic material. Pyrotechnic material comprises a chemical mixture that can be used to generate an exothermic reaction by combustion, deflagration, or detonation to produce visual and audio effects. The material may include an oxidizing agent (oxidant) and a fuel that produces the reaction when heated to its ignition temperature. The cartridge may have electrical contacts operable to receive a detonation signal to heat the fuel.

According to one embodiment, firing device 20 may be operable to fire a cartridge in a predetermined direction. Firing device 20 may be arranged and mounted in housing 50 such that device 20 fires in the predetermined direction when housing 50 is placed in a stable position on the ground. In one embodiment, firing device 20 may be configured to fire the cartridge in a direction that minimizes the hazards of the simulation, maximizes the accuracy of the simulation, or both minimizes the hazards and maximizes the accuracy. For example, firing device 20 may be configured to fire a cartridge in a substantially vertical direction away from the surface of the earth, while minimizing projectiles traveling in a direction horizontal to the surface of the earth. Firing device 20 may have any suitable safety radius that designates a region safe from the hazards of an explosion of firing device 20. For example, firing device 20 may be have a safety radius of less than 100, 50, or 20 feet.

Control module 24 represents a module operable to control the operation of system 10. According to one embodiment, control module 24 initiates detonation of firing devices 20 by sending a detonation signal to firing devices 20. In one embodiment, control module 24 initiates detonation in accordance with a trigger event. For example, control module 24 may initiate detonation in response to receiving a trigger signal from a trigger device that detects a trigger event.

Any suitable trigger device operable to detect a trigger event and send a trigger signal in response to detecting the event may be used. As a first example, a remote control 36 or command wire may detect a user inputting a command, such as pressing a button. As a second example, a motion sensor may detect motion. As a third example, a photoelectric beam detector may detect disruption of a photoelectric beam. As a fourth example, a trip wire detector may detect movement of a wire. As a fifth example, a vibration sensor may detect the vibration of vehicle movement. As a sixth example, a passive infrared detector may detect a change in infrared radiation. As a seventh example, a pressure plate may detect a change in pressure on a plate.

Control module 24 may include user controls 54. A user control may allow a user to provide commands to control module 24. User controls may include an arming delay selector 58. An arming delay selector 58 may be used to select a delay in between arming and detonation of firing devices 20. The delay may be used as a safety feature to provide for time prior to detonation.

Transceiver 28 represents a device operable to communicate signals with remote 36. For example, transceiver 28 may transmit, receive, or both transmit and receive signals over an air interface. Transceiver 28 may be used to receive signals from remote 36 to trigger detonation of firing devices 20. Any suitable transceiver 28 may be used. For example, transceiver 28 may comprise a 315 MHz wireless transceiver operable to initiate the operation of system 10 from 250-350 meters, for example, approximately 300 meters.

Power supply 32 represents a device operable to provide power for the operation of system 10. Power supply 32 may be selected to provide a suitable amount of power over a suitable period of time without requiring recharging. For example, power supply 32 may comprise a 12 volt rechargeable battery that can operate for two to four weeks before requiring recharging.

Remote control 36 represents a device operable to communicate with system 10 over a wireless link, and may communicate signals to, from, or both to and from transceiver 28. Remote control 36 may include user controls 38 that a user may use to send commands to system 10. For example, user controls 38 may include a button that may be used to create a trigger event to initiate detonation.

One or more interfaces 40 may be used to couple external devices to system 10. According to the illustrated embodiment, interfaces 40 include a trigger device port 60, a battery charger port 62, and an other external device port 64. Trigger device port 60 may be used to couple a trigger device to system 10. Trigger device port 60 may comprise a normally open circuit that fires when closed. External trigger port 60 may allow for the use of any suitable plug and play trigger device. Charger interface 62 may be used to couple a power supply charger to power supply 32.

Other external device interface 64 may be used to couple any suitable external device to system 10. An exemplary external device may comprise a hit simulator that simulates projectiles resulting from the detonation. As an example, a laser source may be used to generate laser beams that simulate projectiles of the blast. A detector proximate to system 10 may record a hit if it detects a laser beam. Other exemplary external devices may include smoke pots, rockets, or other devices.

One or more interfaces 40 may be used to perform other suitable operations, such as receive commands or provide information. For example, interfaces 40 may include an arming switch 70 and a detonation indicator 72. Arming switch 70 may be used to arm system 10. Firing devices 20 may not be operable to detonate unless arming switch 70 is selected to arm system 10. Detonation indicator 72 may indicate when a detonation is about to occur. Detonation indicator 72 may include, for example, a visual or audio signal such as a light or a buzzer.

Housing 50 may be used to house one or more components of system 10. As an example, housing 50 may house firing devices 20, control module 24, transceiver 28, power supply 32, and remote control 36. One or more components of system 10 may be readily removed from housing 50. For example, remote control 36 may be readily removed from housing 50.

Housing 50 may be used to transport and protect components of system 10. The components may be, for example, carried by hand in housing 50. According to one embodiment, housing 50 may comprise a case with a lid that may be opened and closed. Housing 50 may allow for firing devices 20 to detonate with the lid closed. For example, the lid may have openings through which each firing device 20 may fire.

System 10 may include other features, for example, safety features that reduce the hazards of detonation. As an example, system 10 may include an electromagnetic discharge filter that may prevent static electricity discharges. As another example, system 10 may include a loose latch feature that provides for quick disconnection and reconfiguration. The loose latch feature may allow system 10 to be repackaged into configurations replicating the tactics, techniques, and procedures of terrorists, insurgents, and enemy forces.

As another example, system 10 may include a buzzer to check set-up distances. As another example, system 10 may include a safety cover that may be placed over firing devices 20. The safety cover may prevent injury in the event of, for example, unintended detonation of firing devices 20.

Modifications, additions, or omissions may be made to system 10 without departing from the scope of the invention. The components of system 10 may be integrated or separated according to particular needs. Moreover, the operations of system 10 may be performed by more, fewer, or other modules. For example, the operations of control module 24 may be performed by more than one module. Additionally, operations of system 10 may be performed using any suitable logic comprising software, hardware, other logic, or any suitable combination of the preceding. As used in this document, "each" refers to each member of a set or each member of a subset of a set.

FIG. 2 is a diagram illustrating an example of the embodiment of system 10 of FIG. 1. According to the example, system 10 includes firing devices 20, control module 24, transceiver 28, power supply 32, remote 36, and interfaces 40. Control module 24 includes user controls 54 such as arming delay selector 58. Interfaces include a charger port 62, an external trigger port 60, other external device port 64, arming switch 70, and detonation indicator 72.

According to the example, system 10 may have any suitable weight, for example, less than 50, 25, or 10 pounds. System 10 may have any suitable volume, for example, less than 5, 3, or 2 cubic feet.

Certain embodiments of the invention may provide one or more technical advantages. A technical advantage of one embodiment may be that an explosion simulator may utilize pyrotechnic firing devices that fire pyrotechnic cartridges. The pyrotechnic firing devices may yield a more realistic simulation of an explosion.

Another technical advantage of one embodiment may be that firing devices of an explosion simulator may be designed to direct an explosion in a predetermined direction. For example, the explosion may be directed in a vertical direction perpendicular to the surface of the earth, while projectiles in a horizontal direction parallel to the surface of the earth are minimized. Directing the explosion in this manner may reduce risk of injury to participants.

Yet another technical advantage of one embodiment may be that an explosion simulator may include one or more ports operable to couple external devices to the simulator. The external devices may include any of a variety of external trigger devices. The ports may allow for different types of trigger devices to be used in a simulation.

While this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A system for simulating an actual explosion of an explosive device, comprising:

one or more firing devices operable to generate one or more pyrotechnic explosions to simulate an actual explosion of an explosive device, a firing device of the one or more firing devices comprising a pyrotechnic device operable to direct a pyrotechnic explosion of the one or more pyrotechnic explosions in a predetermined direction;

a control module coupled to the one or more firing devices and operable to:

receive a trigger signal from a trigger device, the trigger device operable to send the trigger signal in response to a trigger event; and detonate the one or more firing devices in response to the trigger signal; and a housing, the one or more firing devices and the control module disposed within the housing.

2. The system of claim 1, wherein the explosive device comprises an improvised explosive device.

3. The system of claim 1, wherein the one or more firing devices are coupled to a housing to direct the one or more pyrotechnic explosions in a vertical direction substantially perpendicular to the ground.

4. The system of claim 1, further comprising:

an external device port operable to couple an external device to the control module.

5. The system of claim 1, further comprising:

an external trigger device port operable to couple the trigger device to the control module.

6. The system of claim 1, further comprising:

a remote control operable to transmit a command to the control module over a wireless link.

7. The system of claim 1, further comprising:

a transceiver operable to receive a command transmitted over a wireless link.

8. The system of claim 1, further comprising:

a power supply operable to provide power to the control module.

9. The system of claim 1, further comprising:

the housing comprising one or more openings through which the one or more firing devices may direct the one or more pyrotechnic explosions.

10. A method for simulating an actual explosion of an explosive device, comprising:

receiving at a control module a trigger signal from a trigger device, the trigger device operable to send the trigger signal in response to a trigger event;

in response to the trigger signal, detonating one or more firing devices to generate one or more pyrotechnic explosions to simulate an actual explosion of an explosive device, a firing device of the one or more firing devices comprising a pyrotechnic device operable to direct a pyrotechnic explosion of the or more pyrotechnic explosions in a predetermined direction; and a housing, the one or more firing devices and the control module disposed within the housing.

11. The method of claim 10, wherein the explosive device comprises an improvised explosive device.

12. The method of claim 10, further comprising:

directing the one or more pyrotechnic explosions in a vertical direction substantially perpendicular to the ground.

13. The method of claim 10, further comprising:

communicating with an external device coupled to the control module through an external device port.

14. The method of claim 10, wherein receiving at the control module the trigger signal from the trigger device further comprises:

receiving the trigger signal through an external trigger device port operable to couple the trigger device to the control module.

15. The method of claim 10, further comprising:

transmitting a command from a remote control to the control module over a wireless link.

16. The method of claim 10, further comprising:

receiving at a transceiver a command transmitted over a wireless link.

17. The method of claim 10, further comprising:

providing power to the control module using a power supply.

18. The method of claim 10, further comprising:

the housing comprising one or more openings through which the one or more firing devices may direct the one or more pyrotechnic explosions.

19. A system for simulating an actual explosion of an explosive device, comprising:

means for receiving at a control module a trigger signal from a trigger device, the trigger device operable to send the trigger signal in response to a trigger event;

means for, in response to the trigger signal, detonating one or more firing devices to generate one or more pyrotechnic explosions to simulate an actual explosion of an explosive device, a firing device of the one or more firing devices comprising a pyrotechnic device operable to direct a pyrotechnic explosion of the or more pyrotechnic explosions in a predetermined direction; and a housing, the one or more firing devices and the control module disposed within the housing.

20. A system for simulating an actual explosion of an explosive device, comprising:

one or more firing devices operable to generate one or more pyrotechnic explosions to simulate an actual explosion of an explosive device, the explosive device comprising an improvised explosive device, a firing device of the one or more firing devices comprising a pyrotechnic device operable to direct a pyrotechnic explosion of the one or more pyrotechnic explosions in a vertical direction substantially perpendicular to the ground;

a control module coupled to the one or more firing devices and operable to:

receive a trigger signal from a trigger device, the trigger device operable to send the trigger signal in response to a trigger event; and detonate the one or more firing devices in response to the trigger signal;

an external device port operable to couple an external device to the control module;

an external trigger device port operable to couple the trigger device to the control module;

a remote control operable to transmit a command to the control module over a wireless link;

a transceiver operable to receive the command transmitted over the wireless link;

a power supply operable to provide power to the control module; and a housing, the one or more firing devices and the control module disposed within the housing, comprising one or more openings through which the one or more firing devices may direct the one or more pyrotechnic explosions.

* * * * *

UNITED STATES PATENT AND TRADEMARK OFFICE

CERTIFICATE OF CORRECTION

PATENT NO. : 7,597,047 B2
APPLICATION NO. : 11/427855
DATED : October 6, 2009
INVENTOR(S) : Doyle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 299 days.

Signed and Sealed this

Twenty-eighth Day of September, 2010

David J. Kappos

David J. Kappos
*Director of the United States Patent and Trademark Office*